US006218353B1

(12) United States Patent
Romack et al.

(10) Patent No.: US 6,218,353 B1
(45) **Date of Patent: *Apr. 17, 2001**

(54) SOLID PARTICULATE PROPELLANT SYSTEMS AND AEROSOL CONTAINERS EMPLOYING THE SAME

(75) Inventors: Timothy J. Romack, Durham; David F. Cauble, Jr., Charlotte; James B. McClain, Raleigh, all of NC (US)

(73) Assignee: MiCell Technologies, Inc., Raleigh, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,674

(22) Filed: Dec. 14, 1998

Related U.S. Application Data

(63) Continuation-in-part of application No. 09/140,867, filed on Aug. 27, 1998, now abandoned, which is a continuation-in-part of application No. 08/921,620, filed on Aug. 27, 1997, now Pat. No. 5,858,022.

(51) Int. Cl.[7] ..... D06L 1/00; C11D 1/00; A61L 9/14; A01N 25/06

(52) U.S. Cl. ..... 510/406; 252/302; 252/304; 252/305; 252/306; 252/308; 252/309; 252/310; 252/311; 252/320; 252/321; 510/285; 510/289; 510/290; 510/291; 510/279; 510/280; 510/405; 510/418; 510/397; 424/43; 424/45; 424/46; 8/142; 71/64.08; 106/311

(58) Field of Search ..... 8/137, 142; 252/302, 252/304, 305, 306, 308, 309, 310, 311, 320, 321; 510/285, 289, 290, 291, 279, 280, 405, 406, 418, 397; 424/43, 45, 46; 71/64.08; 106/311

(56) References Cited

U.S. PATENT DOCUMENTS

| | | | | |
|---|---|---|---|---|
| 2,524,590 | * | 10/1950 | Boe | 252/305 |
| 3,694,546 | * | 9/1972 | Roth et al. | 424/45 |
| 4,139,607 | * | 2/1979 | Simons et al. | 424/45 |
| 4,161,458 | * | 7/1979 | Kolleth | 252/305 |
| 4,219,333 | * | 8/1980 | Harris | 8/137 |
| 4,243,548 | * | 1/1981 | Heeb et al. | 252/305 |
| 4,912,793 | | 4/1990 | Hagiwara | 8/158 |
| 4,970,093 | * | 11/1990 | Sievers et al. | 427/575 |
| 5,169,433 | * | 12/1992 | Lindsay et al. | 504/324 |
| 5,178,871 | * | 1/1993 | Thill | 525/405 |
| 5,267,455 | | 12/1993 | Dewees et al. . | |
| 5,279,615 | | 1/1994 | Mitchell et al. | 8/142 |
| 5,301,664 | * | 4/1994 | Sievers et al. | 128/200.23 |
| 5,370,742 | | 12/1994 | Mitchell et al. | 134/10 |
| 5,377,705 | | 1/1995 | Smith, Jr. et al. | 134/95.3 |
| 5,412,958 | | 5/1995 | Iliff et al. . | |
| 5,431,843 | | 7/1995 | Mitchell et al. | 252/186.38 |
| 5,467,492 | | 11/1995 | Chao et al. | 8/159 |
| 5,486,212 | | 1/1996 | Mitchell et al. | 8/142 |
| 5,669,251 | | 9/1997 | Townsend et al. . | |
| 5,676,705 | | 10/1997 | Jureller et al. | 8/142 |
| 5,683,473 | | 11/1997 | Jureller et al. | 8/142 |
| 5,683,977 | | 11/1997 | Jureller et al. | 510/286 |
| 5,759,209 | | 6/1998 | Adler et al. | 8/142 |

FOREIGN PATENT DOCUMENTS

| | | |
|---|---|---|
| 39 04 514 A1 | 8/1990 | (DE) . |
| 0 518 653 A1 | 12/1992 | (EP) . |
| 0 732 154 A1 | 9/1996 | (EP) . |
| WO 94/01613 | 1/1994 | (WO) . |
| WO 96/27704 | 9/1996 | (WO) . |
| WO 97/16264 | 5/1997 | (WO) . |
| WO 98/34595 * | 8/1998 | (WO) . |

OTHER PUBLICATIONS

Manfred Wentz; *Textile Cleaning with Carbon Dioxide*?; Copyright© 1995 By R.R. Street & Co. Inc. (Month Unknown).

International Search Report, dated Oct. 12, 1998 for PCT/US 98/17730.

Abstract XP–002085400; *NCSU College of Textiles' Researcher Develops Environmentally Sound $CO_2$ Dry Cleaning, Southern Textile News*, 53(33:12): 1 page, Aug. 25, 1997.

Abstract XP–002085399; DeSimone et al.; *Design and Utilization of Surfactants for $CO_2$, 213th ACS National Meeting*, Apr. 13–17, 1997.

* cited by examiner

*Primary Examiner*—Alan Diamond
(74) *Attorney, Agent, or Firm*—Myers Bigel Sibley & Sajovec

(57) ABSTRACT

A liquid composition useful for suspending and dispensing a solid particulate comprises carbon dioxide, a surfactant, an organic co-solvent, and the solid particulate to be suspended. The composition may optionally contain water. The composition is useful as a propellant in an aerosol container for spraying the solid particulate from the container.

14 Claims, No Drawings

SOLID PARTICULATE PROPELLANT SYSTEMS AND AEROSOL CONTAINERS EMPLOYING THE SAME

This application is a continuation in part of commonly owned, patent application Ser. No. 09/140,867; filed Aug. 27, 1998, now abandoned, which is a continuation-in-part of commonly owned, patent application Ser. No. 08/921,620, filed Aug. 27, 1997, now U.S. Pat. No. 5,858,022, the disclosures of both of which are incorporated by reference herein in their entirety.

FIELD OF THE INVENTION

The present invention relates to liquid carbon dioxide compositions that contain solid particles. Such compositions may be used, among other things, for spraying or dispensing the solid particles, with the liquid carbon dioxide serving as a propellant. Aerosol containers may be pressurized with systems as described and used to dispense the solid particles, with the carbon dioxide serving as a propellant.

BACKGROUND OF THE INVENTION

Numerous different aerosol formulations are known, and there are numerous applications for the spraying or dispensing of an ingredient with a propellant. Because there are environmental concerns associated with many common propellants, there is a continued need to develop alternative propellant systems.

Carbon dioxide has been used as an aerosol propellant for many years (see, e.g., U.S. Pat. No. 2,524,590 to Boe), but was, in general, replaced by the current generation of propellants.

U.S. Pat. No. 5,169,433 to Lindsay et al. describes methods of preparing mixtures of active ingredients and excipients using liquid carbon dioxide, but requires the suspended material to be substantially soluble in the carbon dioxide.

U.S. Pat. No. 5,301,664 and U.S. Pat. No. 4,970,093, both to Sievers, concern methods of generating aerosols with a carbon dioxide propellant, but the carbon dioxide is used in a supercritical state. Supercritical carbon dioxide requires high-pressure containment.

U.S. Pat. No. 4,161,458 concerns the formulation of water-based aerosols using carbon dioxide as a propellant.

U.S. Pat. No. 4,139,607 to Simons describes the use of mixed propellant systems in which fluorinated dimethyl ethers are employed in liquid form and carbon dioxide is employed in gaseous form.

Means for delivering particulate matter (i.e., solid particles) with a liquid carbon dioxide propellant have neither been suggested nor described.

SUMMARY OF THE INVENTION

Without wishing to be bound to any particular theory of the instant invention, we have found a method for dry-cleaning articles such as fabrics and clothing in carbon dioxide, which method comprises contacting an article to be cleaned with a liquid dry cleaning composition for a time sufficient to clean the fabric. The liquid dry-cleaning composition comprises a mixture of carbon dioxide, water, a surfactant, and an organic co-solvent. When used to clean particulate matter from a substrate, the process forms a liquid composition comprising a mixture of carbon dioxide, water, a surfactant, an organic co-solvent, and the suspended particulate matter (i.e., solid particles). Such liquid compositions (with water being optional) may advantageously be used for a variety of purposes in addition to dry cleaning, such as dispensing the particulate matter from the carbon dioxide liquid, as explained below.

Preferably, the liquid composition is at ambient temperature, of about 0° C. to 30° C. The surfactant is soluble in the co-solvent. The surfactant may or may not be soluble in the $CO_2$. Hence, in one embodiment, the surfactant may contain a $CO_2$-philic group. However, in the preferred embodiment, the surfactant does not contain a $CO_2$-philic group. Hence, an advantage of the present invention is that, by proper use of the co-solvent, conventional surfactants may be employed in a liquid carbon dioxide systems. Further, where the particulate is difficult to suspend in the solution, use of a co-solvent with a surfactant that does contain a $CO_2$-philic group may advantageously be employed to better suspend the particulate.

DETAILED DESCRIPTION OF THE INVENTION

The present invention may be employed with any solid particulate material to be suspended. Such solid particles may be formed of organic or inorganic compounds, including polymeric and non-polymeric compounds. The particles may be mixtures of compounds. The particles may be small particles (i.e., about 0.01, 0.1 or 1 to 5 or 10 microns in diameter) or larger particles (i.e., about 5 or 10 microns up to 50, 100 or 500 microns in diameter or more). The particles may be porous or non-porous. Any solid particle material which it may be desired to suspend in the carbon dioxide liquid may be employed, including but not limited to: coatings, abrasive particles, reflective particles, pigments, nanoparticles, carbon particles, opacifiers, talc, deodorants, agricultural chemicals, insecticides, pesticides, herbicides, mycoherbicides, fungicides, fertilizers, drugs, stickers, adjuvants, etc.; soot, lamp-black, silicon oxide, cadmium sulfide, titanium dioxide.

While the present invention is described primarily with respect to the use of solid particles, it may be applied to liquid particles as well.

Liquid compositions useful for carrying out the present invention typically comprise:

(a) from 0.0 or 0.02, 0.05 or 0.1 to 5 or 10 percent by weight (more preferably from 0.0 or 0.1 to 4 percent by weight) water;

(b) carbon dioxide (to balance; typically at least 30 percent by weight);

(c) surfactant (preferably from 0.001, 0.01, 0.05, 0.1 or 0.5 percent by weight to 5, 10, 20 or 40 percent by weight total, which may be comprised of one or more different surfactants);

(d) from 0.1 to 50 percent by weight (more preferably 1, 2 or 4 percent by weight to 30 percent by weight) of an organic co-solvent;

(e) from 0.01, 0.05 or 0.1 to 10, 20, 30 or 50 percent by weight of solid particulate (solid particles).

Percentages herein are expressed as percentages by weight unless otherwise indicated.

The water in the system is not critical, and typically may be carried into the system by the other constituents (i.e., where the carbon dioxide or cosolvent absorbs water, where the solid particles are hygroscopic, etc.). Thus the system may be aqueous or nonaqueous (it being understood that "nonaqueous" systems may still contain small or nominal amounts of water).

The composition is typically provided in liquid form at ambient, or room, temperature, which will generally be between zero and 50° Centigrade. The surfactant and/or the organic co-solvent are included in an amount effective to inhibit aggregation or agglomeration of the solid particles. It is not necessary to completely prevent aggregation or agglomeration of the solid particles; for example, primary particles can agglomerate to some extent as long as the agglomeration is not unduly deleterious to the desired characteristics of the aerosol, or the invention can operate to facilitate redispersion of agglomerated particles upon aerosolization, spraying, or agitation. The composition is preferably held at a pressure that maintains it in liquid form within the specified or desired temperature range.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma)butyrolactone, (epsilon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g., decamethyltetrasiloxane, decamethylpentasiloxane, and hexamethyldisloxane), etc.

Any surfactant can be used to carry out the present invention, including both surfactants that contain a $CO_2$-philic group (such as described in U.S. Pat. No. 5,683,473 to Jureller et al. or U.S. Pat. No. 5,683,977 to Jureller et al) linked to a $CO_2$-phobic group (e.g., a lipophilic group) and (more preferably) surfactants that do not contain a $CO_2$-philic group (i.e., surfactants that comprise a hydrophilic group linked to a hydrophobic (typically lipophilic) group). A single surfactant may be used, or a combination of surfactants may be used. Surfactants as described in U.S. Pat. No. 5,451,633 to DeSimone et al. may be used. Surfactants as described in U.S. Pat. No. 5,789,505 (assigned to Air Products) may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers (e.g., TERGITOL 15-S-3™ secondary alcohol ethoxylate, TRITON X-207™ dinonylphenol ethoxylate, NEODOL 91-2.5™ primary alcohol ethoxylate, RHODASURF BC-410™ isotridecyl alcohol ethoxylate, RHODASURF DA-630™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1-TW™ diethylene glycol monotallowate, TRYDET 2600™ polyoxyethylene (8) monostearate), alkylene oxide block copolymers (e.g., PLURONIC™ and TETRONIC™ products), acetylenic alcohols and diols (e.g., SURFYNOL™ and DYNOL™ products), mono- and di-esters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosucciniamate, AEROSOL 22™ tetrasodium N-(1,2-dicarboxyethyl)-N octadecyl sulfosuccinamate) sorbitan esters including derivatives thereof (e.g., SPAN 80™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21™ polyoxyethylene (4) sorbitan monolaurate), isothionates including derivatives thereof (e.g., GEROPON AC-270™ sodium cocoyl isothionate), polymeric alkylaryl compounds and lignins, including derivatives thereof (e.g., LIGNOSITE 50™ calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10-59™ amine salt of dodecylbenzene sulfonate), sulfonated amines and amides (e.g., CALIMULSE PRS™ isopropylamine sulfonate), Betaine and sultaine derivatives, and salts thereof (e.g., lauryl sulfobetaine, dodecyldimethyl (3-sulfopropyl)ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline derivative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammonium perfluoroalkyl carboxylates), lecithins including lecithin derivatives (e.g., ALCOLEC BS™ soy phosphatides), phosphate esters (e.g., ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE-112N™ phosphated mono- and diglycerides), sulfates and sulfonates of fatty acids (e.g., ACTRASOL PSR™ sulfated castor oil, ACTRASOL SR75™ sulfated oleic acid), sulfates of alcohols (e.g., DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g., CALFOAM ES-301™ sodium lauryl ether sulfate), amines, including salts and derivatives thereof (e.g., Tris(hydroxymethyl)aminomethane, ARMEEN™ primary alkylamines, ARMAC HT™ acetic acid salt of N-alkyl amines) amide sulfonates (e.g., GEROPON TC-42™ sodium N-coconut acid-N-methyl taurate, GEROPON TC 270™ sodium cocomethyl tauride), quaternary amines, including salts and derivatives thereof (e.g., ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquaternary polydimethylsiloxane), amine oxides (e.g., AMMONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CCTM propylene glycol dicaprylate/dicaprate), polysaccharides including derivatives thereof (e.g., GLUCOPON 225 DK™ alkyl polysaccharide ether), protein surfactants (e.g., AMITER LGS-2™ dioxyethylene stearyl ether diester of N-lauroyl-L-glutamnic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCODET™ polyoxyethylene thioether, BURCO TME™ ethoxylated dodecyl mercaptan), etc.

Additional ingredients can be included in the composition as desired. For example, a second, different compressed gas (preferably an inert gas) can be incorporated into the system, in liquid or gaseous form. Other ingredients can be included in the system in soluble or insoluble form, such as polymers, adhesives, rheology modifiers (including random and block copolymers), coatings and the like.

The compositions of the invention are stored in a suitable enclosed pressure vessel that maintains the composition in liquid form, and is suitable for the intended use. Examples of such pressure vessels include aerosol containers, which may be filled with the liquid system so that the solid particulate may be dispensed therefrom, in accordance with known techniques.

The present invention is explained in greater detail in the following non-limiting examples. While these examples are concerned with dry-cleaning systems, it will be appreciated that the same formulations that are employed to clean and suspend solid particulate matter may be employed to simply suspend solid particulate matter in carbon dioxide, with or without the inclusion of water.

EXAMPLES 1–2

This example shows that various $CO_2$ detergent formulations show a significantly enhanced cleaning effect over a commercial perchloroethylene ("perc") dry cleaning system. Small (2"×2") swatches of various delicate (often "dry clean only") cloth were uniformly stained and run in both perc and $CO_2$ cleaning systems. Two $CO_2$ cleaning systems were employed, as follows:

First 0.5% X-207 (a commercial detergent from Union Carbide—Di-nonyl phenyl ethoxylate with a hydrophobic-lipophilic balance (HLB) of about 10.5);

0.5% PDMS-$g_3$-PEG (polydimethyl siloxane-graft-polyethylene glycol copolymer) (500 g/mol PDMS with 350 g/mol PEG grafts ca. 50 wt % PEG);

1% Span™ 80 (a commercial sorbitan ester surfactant from ICI);

0.5% isopropanol;

0.2% water;

30% Isopar™ M (a commercial hydrocarbon solvent manufactured by EXXON); and $CO_2$ to balance; or Second

1% X-207;

1% Span™ 80;

1% isopropanol;

0.2% water;

30% Isoparm™ M; and $CO_2$ to balance.

The second system above is currently preferred.

At a temperature of 22° C. to 27° C., the formulation and cloth was added to the test vessel. The test vessel was pressurized with liquid $CO_2$ to 800–900 psi, with the total liquid volume equal to about half the vessel volume. The cloth was washed with agitation for ten minutes. To rinse, the liquid $CO_2$ was vented, the cloth spun for five minutes, liquid $CO_2$ was again added and pressurized to 800 to 900 psi until the vessel was one half full, and the cloth again agitated for five minutes. The rinse cycle (vent, spin, agitate) was repeated, the system vented and the cloth removed.

Control "perc" samples were run in perchloroethylene using a standard loading of Fabritech™ detergent and sizing, at a local commercial dry cleaner under normal operating conditions. In each case the stained samples of cloth were washed in one of the $CO_2$ mixtures described above, followed by extraction and rinse with clean $CO_2$.

The following cloth samples were run:

1. White linen suiting
2. Acetate taffeta
3. Silk twill
4. 100% wool flannel
5. Bright filament viscose twill
6. Texturized nylon 6,6 stretch fabric
7. Texturized stretch Dacron™

Results are given in Table 1 below. These data show that $CO_2$-based dry cleaning formulations of the present invention have an enhanced cleaning effect as compared to a commercial PERC dry cleaning system.

TABLE 1

| Cloth | Stain | PERC result | CO2 result |
|---|---|---|---|
| 2, 4, 1 | French salad dressing | slight residue remaining | visually clean, no residue |
| 1, 2, 3, 4, 6 | Spaghetti sauce | majority of stain remaining | slight residue remaining |
| 5 | Tea | over ½ of residue remaining, plus darkening of 'ring' around the stained area | slight residue remaining, no 'ring' apparent |
| 2 | Tea | slight residue remaining | visually clean, no residue |
| 5 | Blackberry juice | slight residue remaining | visually clean, no residue |
| 4, 5, 7 | Grass | slight residue remaining | minute residue remaining[1] |
| 4 | Coke ™ cola beverage | ½ of stain remaining | minute residue remaining |
| 4 | Coffee | ½ of stain remaining | minute residue remaining |
| 1 | Egg | no significant removal of stain, slight color change of stain | slight residue remaining |
| 1, 2, 4, 6 | taco sauce | majority of stain remaining | slight residue remaining |

[1]By "minute" is meant significantly less than the perc result.

EXAMPLE 3

An additional liquid carbon dioxide cleaning system, or wash fluid, that can be used in the methods described herein, is a mixture that contains:

2.86% ISOPAR M™ organic solvent;

1.23% DPMA (dipropyleneglycol monomethyl ether acetate);

0.56% TERGITOL 15-S-3™ (Union Carbide secondary alcohol ethoxylate with an HLB of 8.3);

0.28% water;

0.05% TRITON GR-7M™ (commercial detergent from Union Carbide—sodium dioctylsulfosuccinate in petroleum distillates);

0.02% TRITON RW-20™ (commercial detergent from Union Carbide—ethoxylated alkylamines); and liquid carbon dioxide to balance.

EXAMPLE 4

An additional example of a liquid dry cleaning system useful for carrying out the present invention is a mixture that contains:

2.80% DPM (dipropyleneglycol monomethyl ether);

1.20% hexylene glycol;

0.50% TERGITOL 15-S-3™ detergent;

0.50% water; and liquid carbon dioxide to balance.

EXAMPLE 5

An additional example of a liquid dry cleaning system useful for carrying out the present invention is a mixture that contains:

2.80% DPM;

1.20% hexylene glycol;

0.50% TERGITOL 1 5-S-3™ detergent;

0.40% water;

0.10O% C-300™ (commercial detergent formulation from ADCO containing quaternary amines and optical brighteners); and carbon dioxide to balance.

EXAMPLE 6

An additional example of a liquid dry cleaning system useful for carrying out the present invention is a mixture that contains:

2.80% ISOPAR M™ organic solvent;

1.20% DPMA;

0.50% water;

0.35% EMCOL 4500™ (a commercial detergent from Witco—70% dioctyl sodium sulfonate, 30% ethanol, 10% water)

0.15% ACTRAFOS 110™ (Commercial detergent from Actrachem—phosphate ester of complex aliphatic hydroxyl compound); and liquid carbon dioxide to balance.

EXAMPLE 7

An additional example of a liquid carbon dioxide dry cleaning system that can be used to carry out the present invention is a mixture that contains:

2.80% TPM (tripropyleneglycol monomethyl ether);

1.20% propylene carbonate;

0.50% PLURONIC L31™ (commercial detergent from BASF-polyethylene oxide-polypropylene oxide block copolymer);

0.40% water;

0.10% lauryl sulfobetaine; and liquid carbon dioxide to balance.

EXAMPLE 8

An additional example of a liquid carbon dioxide dry cleaning system that can be used to carry out the present invention is a mixture that contains:

2.80% ISOPAR M™ organic solvent;

1.20% DPMA;

0.60% PLURONIC L31™ detergent;

0.60% water;

0.10% cyclohexanol; and liquid carbon dioxide to balance.

EXAMPLE 9

An additional example of a liquid carbon dioxide dry cleaning system that can be used to carry out the present invention is a mixture that contains:

4.0% ISOPAR M™ organic solvent;

0.7% sodium dioctylsulfosuccinate;

0.3% water; and liquid carbon dioxide to balance.

EXAMPLE 10

An additional example of a liquid carbon dioxide dry cleaning system that can be used to carry out the present invention is a mixture that contains:

4.00% ISOPAR M™ organic solvent;

0.62% WITCONATE P1059™ (commercial detergent of Witco—isopropylamine salt of dodecylbenzene sulfonate);

0.35% water;

0.03% TRIS™ pH buffer (tris[hydroxymethyl] aminomethane); and liquid carbon dioxide to balance.

EXAMPLE 11

An additional example of a liquid carbon dioxide dry cleaning system that can be used to carry out the present invention is a mixture that contains:

4.2% ISOPAR M™ organic solvent;

0.24% water;

0. 196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 12

An additional example of a liquid carbon dioxide dry cleaning system that can be used to carry out the present invention is a mixture that contains:

3.07% ISOPAR M™ organic solvent;

1.32% DPMA (diopropylene glycol monomethyl ether acetate);

0.087% water;

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

The liquid dry cleaning systems of Examples 11 and 12 are currently preferred.

EXAMPLES 13–14

Examples 13–14 illustrate the use of liquid carbon dioxide systems of the present invention employed as aerosol propellants for solid particulates to be dispensed.

EXAMPLE 13

An aerosol container is pressurized with a liquid propellant system comprising:

4.2% ISOPAR M™ organic solvent;

0.24% water;

0. 196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons);

0.48% TERGITOL™ 15-S-3 detergent (a commercial detergent of Union Carbide; a secondary alcohol ethoxylate);

1.0% solid particulate to be dispensed by spraying from the aerosol container; and liquid carbon dioxide to balance.

EXAMPLE 14

An aerosol container is pressurized with a liquid propellant system comprising:

3.07% ISOPAR M™ organic solvent;

1.32% DPMA (diopropylene glycol monomethyl ether acetate);

0.087% water;

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate);

2.0% solid particulate to be dispensed by spraying from the aerosol container; and liquid carbon dioxide to balance.

The foregoing is illustrative of the present invention, and is not to be construed as limiting thereof. The invention is defined by the following claims, with equivalents of the claims to be included therein.

That which is claimed is:

1. A liquid composition useful for suspending a solid particulate, said composition comprising:

(a) from 0 to 10 percent by weight water;

(b) carbon dioxide;

(c) from 0.1 to 10 percent by weight surfactant;

(d) from 0.01 to 50 percent by weight of an organic co-solvent having a flash point above 140° C.; and (e) from 0.01 to 50 percent by weight of a solid particulate.

2. A liquid composition according to claim 1, said composition comprising:

(a) from 0 to 4 percent by weight water;

(b) carbon dioxide;

(c) from 0.5 to 5 percent by weight surfactant;

(d) from 4 to 30 percent by weight of said organic co-solvent; and (e) from 1 to 30 percent by weight of a solid particulate.

3. A liquid composition according to claim 1, wherein said surfactant contains a $CO_2$-philic group.

4. A liquid composition according to claim 1, wherein said surfactant does not contain a $CO_2$-philic group.

5. A liquid composition according to claim 1, wherein said organic co-solvent has a flash point above 170° F.

6. A liquid composition according to claim 1, wherein said organic co-solvent is a hydrocarbon co-solvent.

7. A liquid composition according to claim 1, wherein said organic co-solvent is an alkane co-solvent.

8. A liquid composition according to claim 1, further comprising an alcohol.

9. An aerosol container pressurized by a liquid propellant system, said liquid propellant system comprising:

(a) from 0 to 10 percent by weight water;

(b) carbon dioxide;

(c) from 0.1 to 10 percent by weight surfactant;

(d) from 0.01 to 50 percent by weight of an organic co-solvent having a flash point above 140° C.; and (e) from 0.01 to 50 percent by weight of a solid particulate;

wherein said surfactant does not contain a $CO_2$-philic group.

10. An aerosol container according to claim 9, said propellant system comprising:

(a) from 0 to 4 percent by weight water;

(b) carbon dioxide;

(c) from 0.5 to 5 percent by weight surfactant;

(d) from 4 to 30 percent by weight of said organic co-solvent; and (e) from 1 to 30 percent by weight of a solid particulate.

11. An aerosol container according to claim 9, wherein said organic co-solvent has a flash point above 170° F.

12. An aerosol container according to claim 9, wherein said organic co-solvent is a hydrocarbon co-solvent.

13. An aerosol container according to claim 9, wherein said organic co-solvent is an alkane co-solvent.

14. An aerosol container according to claim 9, said propellant system further comprising an alcohol.

* * * * *